US006076192A

United States Patent [19]

Kronenberger

[11] Patent Number: 6,076,192

[45] Date of Patent: Jun. 20, 2000

[54] HEADWEAR PIECE WITH PROJECTING BILL

[75] Inventor: Ronald Kronenberger, Riverwoods, Ill.

[73] Assignee: American Needle, Buffalo Grove, Ill.

[21] Appl. No.: 09/035,326

[22] Filed: Mar. 5, 1998

[51] Int. Cl.[7] ..... A42B 1/00

[52] U.S. Cl. ..... 2/195.6; 2/192; 521/51

[58] Field of Search ..... 521/51, 92; 428/304.4, 428/36.5; 2/192, 172, 195.6, 209.12, 10; 264/415; 156/78, 79

[56] References Cited

U.S. PATENT DOCUMENTS

| | | | |
|---|---|---|---|
| 3,134,983 | 6/1964 | Lipkin | 2/172 |
| 4,423,110 | 12/1983 | Sato | 428/304.4 |
| 4,839,924 | 6/1989 | Laurence | 2/10 |
| 4,982,449 | 1/1991 | Finkelstein | 2/192 |
| 5,665,785 | 9/1997 | McClellan et al. | 521/51 |
| 5,789,453 | 8/1998 | Detterman | 521/92 |
| 5,876,813 | 3/1999 | Bambara et al. | 428/36.5 |

*Primary Examiner*—John J. Calvert
*Assistant Examiner*—Robert H. Muromoto, Jr.
*Attorney, Agent, or Firm*—Wood, Phillips, VanSanten, Clark & Mortimer

[57] ABSTRACT

A headwear piece having a crown portion to extend at least partially around the head of a wearer to maintain the headwear piece in an operative position on a wearer's head and a bill projecting from the crown portion. The bill has a core element with a base layer made from expanded foam.

21 Claims, 3 Drawing Sheets

HEADWEAR PIECE WITH PROJECTING BILL

BACKGROUND OF THE INVENTION

1. Field of the Invention

This invention relates to headwear and, more particularly, to headwear with a projecting bill.

2. Background Art

Baseball-style caps have become exceptionally popular in the headwear industry. The comfortable and lightweight construction of the baseball-style cap, that make it desirable for baseball players, also make it desirable for other recreational activities. Baseball-style caps are commonly seen on both men and women engaging in hunting and fishing activities. Baseball-style caps are also commonly worn by men and women as general outdoor casual wear. Of late, the use of baseball-style caps has even extended to indoor activities. Those persons exercising in gyms and other exercise facilities commonly wear this type of cap not only for protection from the elements and as a light shield but to confine or protect their hair or simply because they like the look of the baseball-style cap.

One of the most desirable features of the baseball-style cap is its versatility. Baseball-style caps are offered in a wide range of quality and price. Baseball-style caps are offered in a wide range of materials and style to appeal to virtually all tastes.

The baseball-style cap is particularly desirable because of its compactable nature which makes it easy to transport. Since normally the crown of the cap is made from fabric, the crown can be readily collapsed and placed in a bag or suitcase for transportation. It is also common practice to fold or collapse the baseball-style cap and to press it within a wearer's waistband or a wearer's pocket for temporary storage thereof.

The primary impediment to convenient folding and collapse of the baseball-style cap is the bill. Typically, the bill consists of a cardboard core, or plastic core made from polyethylene foam, that is sandwiched between two fabric layers which are in turn sewn to the crown. During manufacture, the core, fabric layers, and crown are sewn together so that the bill has a slightly arched shape.

In compacting the cap, the bill is normally folded against itself. This commonly results in the permanent deformation of the core. In the case of plastic, a material weakening at the point of folding may produce a permanent crease. As a result, when the cap is opened up to its normal state, the desired arched look on the bill may be destroyed.

In the case of cardboard, folding likewise tends to produce a crease. Repetitive folding may cause the cardboard to fail at the crease so that the overall integrity of the bill is maintained primarily by the fabric between which the core is captive.

Another problem with the plastic or cardboard core is that, to be shape retentive, it is generally rigid. Aside from the fact that this rigidity minimizes the amount of compaction possible, the core sheet may also be abrasive and cause discomfort to a wearer that has placed the compacted cap in a waistband or pocket.

It is also known to form a bill from coated burlap. However, burlap often does not maintain the desired bill shape effectively and may be prone to creasing.

Ideally, the bill has sufficient rigidity to be shape retentive, is readily reducible to a compact state, is soft enough so as not to produce uncomfortable contact with a user in a compacted state, and is repeatedly restorable to its original shape. Heretofore, cardboard-type materials for the core sheet have realized some of the above objectives. With controlled deformation of the cardboard through repetitive bending, the cardboard tends to soften and maintains a clean arch shape. However, the cardboard, at least initially, is somewhat stiff and prone to permanent deformation, which detracts from the appearance of the cap.

SUMMARY OF THE INVENTION

The invention is directed to a headwear piece having a crown portion to extend at least partially around the head of a wearer to maintain the headwear piece in an operative position on a wearer's head and a bill projecting from the crown portion. The bill has a core element with a base layer made from expanded foam.

In one form, the expanded foam is an expanded polyvinyl chloride.

The crown portion may have an inverted cup shape.

In one form, the bill has first and second sheets of fabric and at least part of the core element resides between the first and second sheets of fabric.

The base layer may have a thickness on the order of at least 0.08 inches.

The core element may include a skin applied over the base layer.

The skin may be made form polyvinyl chloride.

In one form, the thickness of the skin is substantially less than the thickness of the base layer. In one embodiment, the thickness of the skin is on the order of 0.017 inches and the thickness of the base layer is on the order of 0.1 to 0.12 inches.

The skin and base layer may be formed one directly against the other.

In one form, the skin is formed by treating a first liquid to convert the first liquid to a first gel and the base layer is formed by applying a second liquid over the first gel and treating the first gel and second liquid so as to convert the second liquid to a second gel.

The first and second liquids may be converted to gels by a heating process.

During the heating process, the second liquid may be injected with a blowing agent.

In one form, the bill has an exposed, upwardly facing surface with an area and the core element extends over substantially the entire area of the upwardly facing surface.

In one form, the headwear piece has a front and rear and a top and bottom and the bill has an upper surface that is convex, with the skin being applied directly to and at the top of the base layer.

In one form, there is stitching that passes through the first and second sheets and the core element.

The invention is also directed to a bill for a headwear piece, which bill has a core element and a base layer made from expanded foam, and a skin applied to the base layer. The thickness of the base layer is greater than the thickness of the skin.

The invention is further directed to a headwear piece having a crown portion to extend at least partially around the head of a wearer to maintain the headwear piece in an operative position on a wearer's head and a bill projecting from the crown portion, with a bill including a core element having a base layer made from foam with a skin applied directly to the foam.

The foam may be polyvinyl chloride.

The invention is still further directed to a headwear piece having a crown portion to extend at least partially around the head of a wearer to maintain the headwear piece in an operative position on a wearer's head and a bill projecting from the crown portion, with the bill having a core element made from polyvinyl chloride.

DETAILED DESCRIPTION OF THE DRAWINGS

Figure 2:
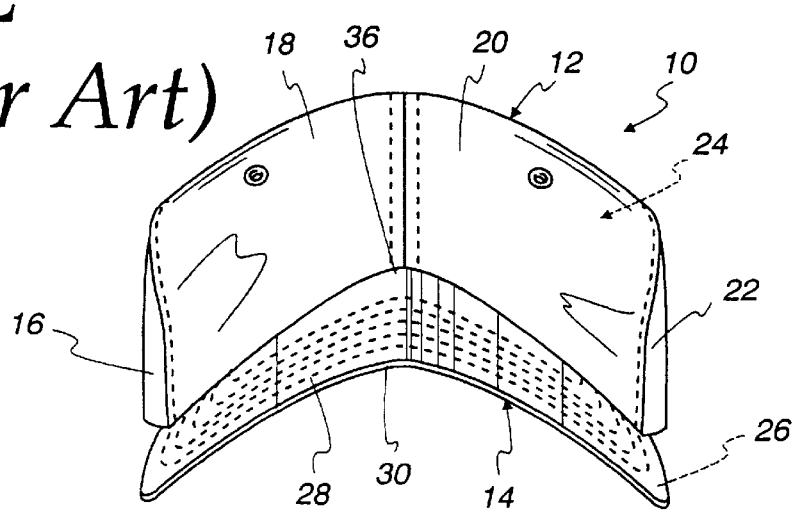
Fig. 2 (Prior Art)
FIG. 2 is a front elevation view of a conventional baseball-style cap, as in FIG. 1, with the bill creased by the action shown in FIG. 1.
Figure 3:
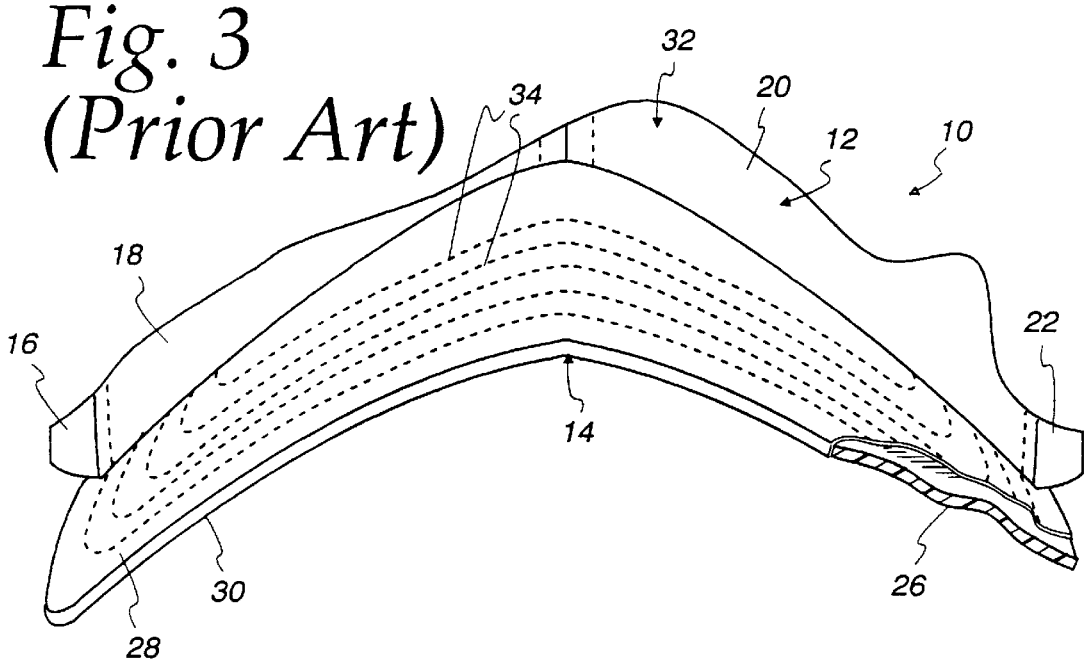
Fig. 3 (Prior Art)
FIG. 3 is an enlarged, fragmentary, partial cross-sectional, front elevation view of the bill creased as in FIG. 2.
Figure 4:
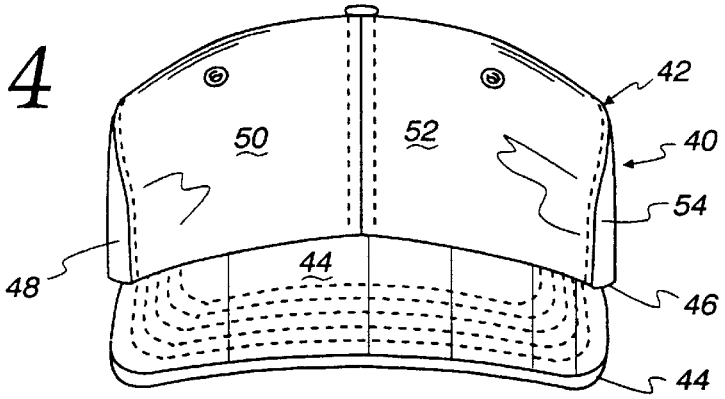
FIG. 4 is a view as in FIG. 2 of a headwear piece/baseball-style cap, made according to the present invention.
Figure 5:
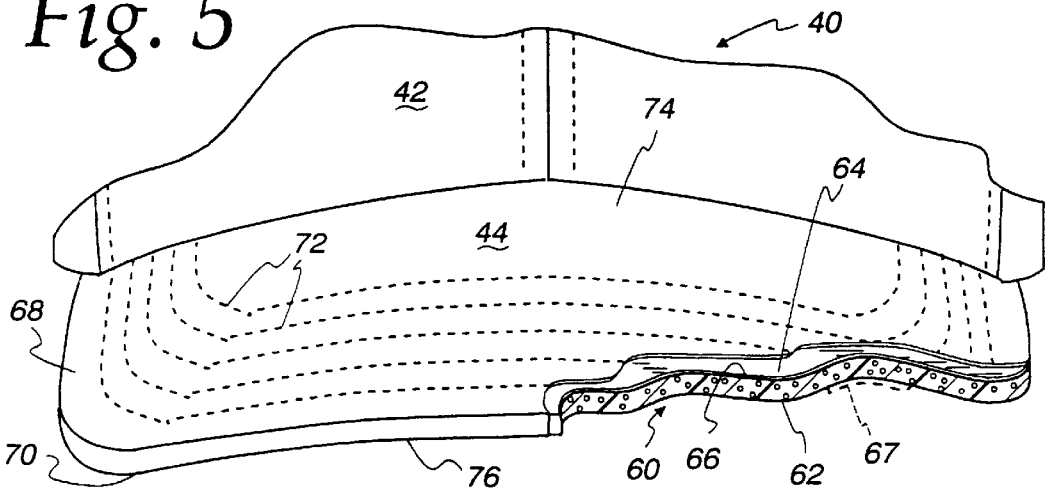
FIG. 5 is an enlarged, fragmentary, partial cross-sectional, front elevation view of a bill on the headwear piece/baseball-style cap of FIG. 4.
Figure 6:
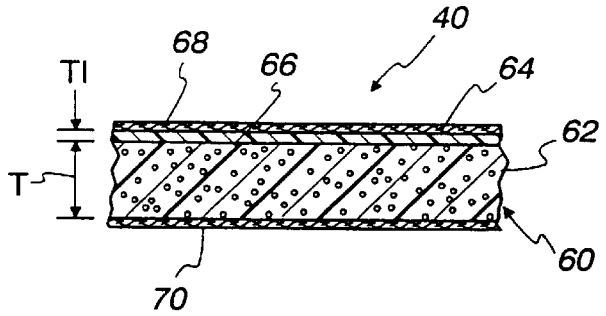
FIG. 6 is an enlarged, cross-sectional view of a portion of the bill on the headwear piece/baseball-style cap in FIG. 5.

In FIGS. 2 and 3, a conventional baseball-style cap is shown at 10. The cap 10 consists of a crown 12 and a bill 14 projecting forwardly from the crown 12. The crown 12 has a plurality of fabric gores 16, 18, 20, 22 sewn edge-to-edge to cooperatively produce a cup-shaped receptacle 24 for a wearer's head. The bill 14 includes a core element 26 that is made from a sheet of relatively hard plastic, such as extruded polyethylene foam, having a thickness on the order of 1/16 inch. The core element 26 is sandwiched between two fabric sheets 28, 30, which extend rearwardly beyond the core element 26 for attachment to a front wall 32 on the crown 12. Lines of stitching 34 pass through the fabric sheets 28, 30 and core element 26. The fabric sheets 28, 30 and core element 26 are united with each other and the crown 12 in such a manner that the bill 14 assumes an inverted arched or "U" shape, as viewed from the front of the cap 10.

Figure 1:
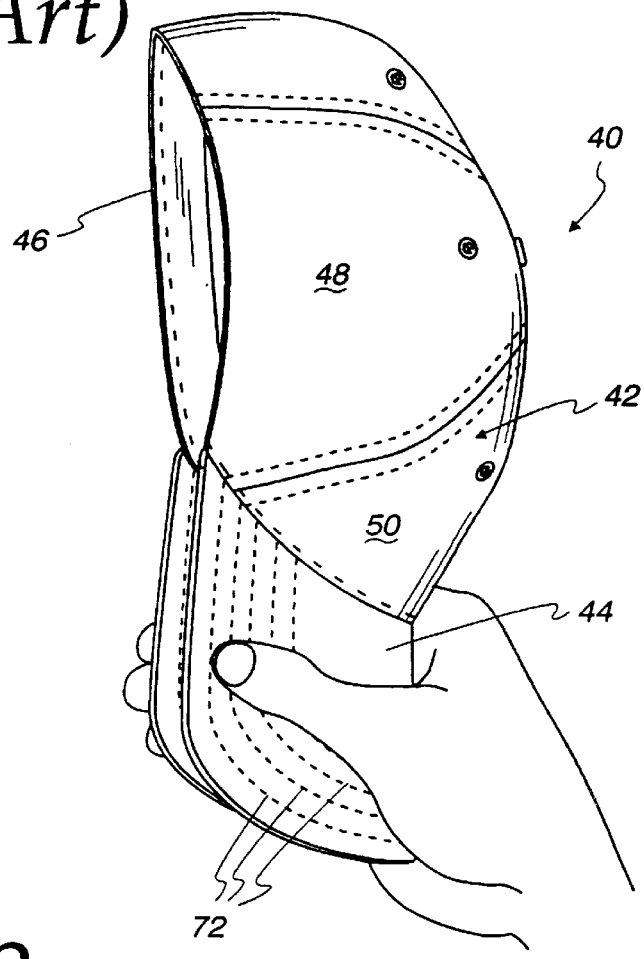
Fig. 1 (Prior Art)
FIG. 1 is a side elevation view of a baseball-style cap having a crown and bill, with the bill being collapsed in a wearer's hand.

It is common for a wearer of a cap, such as that shown at 10, to compact the cap 10 by folding the core element 26 about a fore and aft center line 36, as shown in FIGS. 1 and 2. While the conventional material used for the bill 14 has a certain amount of shape memory, it is also prone to being permanently deformed. In this case, the core element 26 is creased along the line 36 by a folding action as shown in FIG. 1 and maintains a residual peak, whereas more preferably the bill 14 will maintain a curved shape which approximates the curvature of an arc on a constant center.

In FIGS. 1 and 4–6, a headwear piece/baseball-style cap, according to the present invention, is shown at 40. The headwear piece 40 has a cup-shaped crown portion 42 to receive the wearer's head and a bill 44 projecting forwardly from the crown portion 42. The crown portion 42 has a lower edge 46 which extends through 360° to frictionally engage a wearer's head to thereby maintain the headwear piece 40 in an operative position on a wearer's head.

It is not necessary that the edge 46 extend through 360°. Further, while the crown portion 42 is show to be made from a plurality of fabric gores 48, 50, 52, 54 sewn edge-to-edge to produce a closed receptacle, the crown portion 42 can be made in the form of a visor, i.e. with an opening through the top of the crown, or in another form, i.e. as one piece, without altering the function of the present invention.

The bill 44 has generally the same shape as the bill 14 on the cap 10, previously described. The bill 44 has a core element 60 which consists of a base layer 62 made from an expanded foam. In a preferred form, the foam defining the base layer 62 is an expanded, closed cell, polyvinyl chloride. The core element 60 includes a skin 64 that is applied directly over the upper surface 66 of the base layer 62. In a preferred form, the skin 64 is made from polyvinyl chloride. An optional second skin 67 (shown in dotted lines in FIG. 5) could be applied on the lower surface of the base layer 62.

The core element 60 is sandwiched between upper and lower fabric sheets 68, 70. Lines of stitching 72 pass through and unite the fabric sheet 68, 70 and core element 60 to maintain the bill 44 in the arch/inverted "U" shape, as previously described. The fabric sheets 68,70 extend rearwardly and are stitched to the crown portion 42 to define a unitary construction. The core element 60 preferably extends over substantially the entire area of the upper and lower surfaces 74, 76 of the bill 44.

In one preferred form, the base layer 62 has a thickness T on the order of at least 0.08 inches and more preferably in the range of 0.1 to 0.12 inches. The base layer 62 has a weight of approximately 40 oz./yd.$^2$ The skin has a thickness T1 on the order of 0.17 inches. These dimensions may be varied depending upon the amount 20 of flexibility that is desired for the bill 44.

The skin 64 and base layer 62 cooperate to permit the bill 44 to be collapsed without excessive force application and at the same time account for excellent shape memory. The assignee herein has recently introduced the headwear, as described herein, in a product sold under the trademark MAC DADDY™. The bills on these caps can be folded to a very compact state by the action shown in FIG. 1 and restored to a highly desirable appearance. This allows the wearer to fold the bill 44, as to put the entire headwear piece 40 in a pocket or other compact receptacle, without significantly altering the appearance of the cap when it is restored to its normal useable state.

Figure 7:
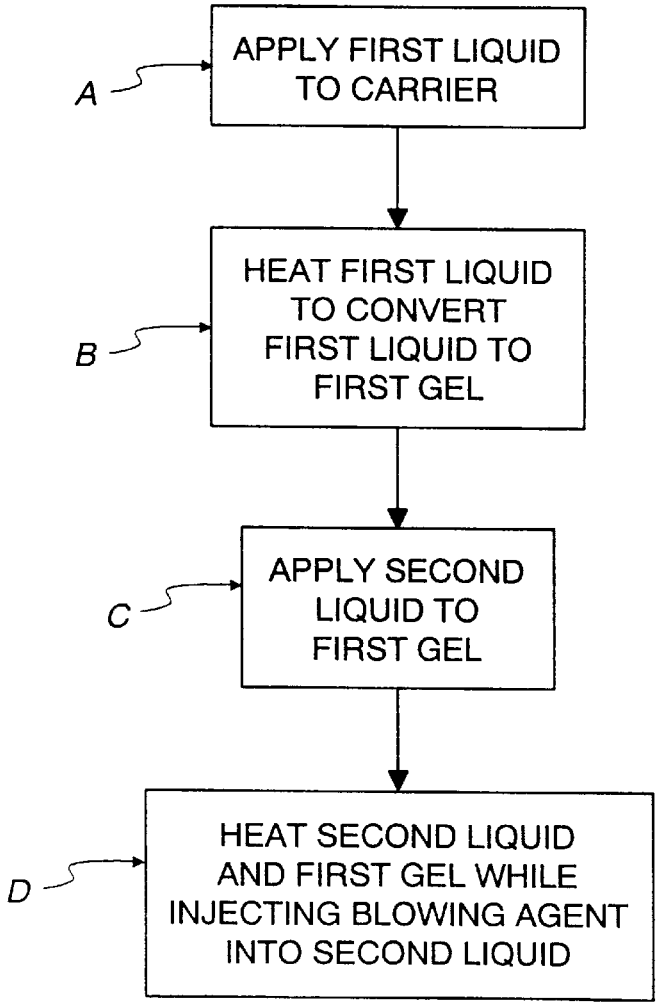
FIG. 7 is a schematic representation of a process used to form a core element on the bill on the inventive headwear piece/baseball-style cap.

To define the core element 60, a series of steps may be carried out as shown in FIG. 7. In step A, polyvinyl chloride is applied in liquid form to a carrier. In step B the carrier is advanced into an oven to convert the first liquid to a first gel. The carrier with the first gel thereon is removed from the oven to allow application of a second liquid directly against the first gel, as shown at step C. The carrier with the first gel and second liquid applied thereto is then heated while injecting a blowing agent into the second liquid to produce an exposed, closed cell construction.

The base layer 62 and skin 64 could alternatively be formed in a single operation using a procedure known to those skilled in the art.

The thickness and density of the base layer 62 and skin 64 can be varied to produce the desired flexibility and memory for the core element 60.

The core element 60 can be used on all different types of headwear, and in fact could be used as an isolated bill, as may be applied to eyeglasses, or otherwise, to be maintained in an operative position on a wearer's head.

The foregoing disclosure of specific embodiments is intended to be illustrative of the broad concepts comprehended by the invention.

I claim:

1. A headwear piece comprising:

a crown portion to extend at least partially around the head of a wearer to maintain the headwear piece in an operative position on a wearer's head; and a bill projecting from the crown portion, wherein the bill comprises a core element comprising a base layer comprising expanded foam, the core element further comprising a polyvinyl chloride skin applied over the base layer.

2. The headwear piece according to claim 1 wherein the expanded foam comprises expanded polyvinyl chloride.

3. The headwear piece according to claim 2 wherein the bill comprises first and second sheets of fabric and at least a part of the core element resides between the first and second sheets of fabric.

4. The headwear piece according to claim 2 wherein the base layer has a thickness on the order of at least 0.08 inches.

5. The headwear piece according to claim 1 wherein the skin and base layer each have a thickness and the thickness of the skin is substantially less than the thickness of the base layer.

6. The headwear piece according to claim 5 wherein the thickness of the skin is on the order of 0.017 inches and the thickness of the base layer is on the order of 0.01–0.12 inches.

7. The headwear piece according to claim 1 wherein the skin and base layer are formed one directly against the other.

8. The headwear piece according to claim 1 wherein the skin is formed by treating a first liquid to convert the first liquid to a first gel and the base layer is formed by applying a second liquid over the first gel and treating the first gel and second liquid so as to convert the second liquid to a second gel.

9. The headwear piece according to claim 8 wherein first and second liquids are converted to the first and second gels by a heating process.

10. The headwear piece according to claim 8 wherein the treating of the second liquid comprises injecting a blowing agent into the second liquid.

11. The headwear piece according to claim 2 wherein the bill has an exposed upwardly facing surface with an area and the core element extends over substantially the entire area of the upwardly facing surface.

12. A headwear piece comprising:

a crown portion to extend at least partially around the head of a wearer to maintain the headwear piece in an operative position on a wearer's head; and a bill projecting from the crown portion, wherein the bill comprises a core element comprising a base layer comprising expanded foam, wherein the expanded foam comprises expanded polyvinyl chloride, wherein the core element comprises a skin applied over the base layer, wherein the headwear piece has a front and rear and a top and bottom, the bill has an upper surface that is convex and the skin is applied directly to and at the top of the base layer.

13. The headwear piece according to claim 2 wherein the crown portion has an inverted cup shape.

14. The headwear piece according to claim 3 wherein there is stitching that passes through the first and second sheets and the core element.

15. A bill for a headwear piece, said bill comprising:

a core element comprising a base layer comprising expanded foam and a skin applied to the base layer, wherein the base layer and skin each have a thickness and the thickness of the base layer is greater than the thickness of the skin, wherein one of the skin and base layer is pre-formed and the other of the skin and base layer is formed directly against the one of the skin and base layer after the one of the skin and base layer is pre-formed.

16. The bill for a headwear piece according to claim 15 wherein the expanded foam comprises polyvinyl chloride.

17. The bill for a headwear piece according to claim 15 wherein the bill comprises first and second sheets of fabric and at least a part of the core element resides between the first and second sheets of fabric.

18. The bill for a headwear piece according to claim 16 wherein the skin comprises polyvinyl chloride.

19. A headwear piece comprising:

a crown portion to extend at least partially around the head of a wearer to maintain the headwear piece in an operative position on a wearer's head; and a bill projecting from the crown portion, wherein the bill comprises a core element comprising a base layer comprising polyvinyl chloride with a skin separately applied and bonded directly to the polyvinyl chloride.

20. The headwear piece according to claim 19 wherein the skin comprises polyvinyl chloride.

21. A headwear piece comprising:

a crown portion to extend at least partially around the head of a wearer to maintain the headwear piece in an operative position on a wearer's head; and a bill projecting from the crown portion, wherein the bill comprises a core element comprising polyvinyl chloride and a base layer against which the polyvinyl chloride is directly applied.

* * * * *